US007194777B2

(12) United States Patent
Edling et al.

(10) Patent No.: US 7,194,777 B2
(45) Date of Patent: Mar. 27, 2007

(54) POCKET MATTRESS WITH VARYING HEIGHT

(76) Inventors: Kenneth Edling, Ringvagen 27, SE-524 31 Herrljunga (SE); Mikael Johansson, St. Gotgatan 55, SE-524 30 Herrljunga (SE)

( * ) Notice: Subject to any disclaimer, the term of this patent is extended or adjusted under 35 U.S.C. 154(b) by 126 days.

(21) Appl. No.: 10/521,824

(22) PCT Filed: Oct. 24, 2003

(86) PCT No.: PCT/SE03/01656

§ 371 (c)(1),
(2), (4) Date: Jan. 20, 2005

(87) PCT Pub. No.: WO2004/039215

PCT Pub. Date: May 13, 2004

(65) Prior Publication Data

US 2005/0257323 A1 Nov. 24, 2005

(30) Foreign Application Priority Data

Oct. 29, 2002 (SE) ..... 0203163

(51) Int. Cl.
*A47C 27/04* (2006.01)

(52) U.S. Cl. ..... 5/720; 5/716; 5/727; 267/89; 267/93

(58) Field of Classification Search ..... 5/720, 5/727, 716, 655.8; 267/89, 91, 93
See application file for complete search history.

(56) References Cited

U.S. PATENT DOCUMENTS

| | | | | |
|---|---|---|---|---|
| 4,439,977 | A * | 4/1984 | Stumpf | 53/428 |
| 6,122,900 | A * | 9/2000 | Mossbeck et al. | 53/529 |
| 6,170,807 | B1 * | 1/2001 | Eto | 267/103 |
| 6,826,796 | B1 * | 12/2004 | Mossbeck | 5/720 |
| 6,834,477 | B2 * | 12/2004 | De Santis et al. | 53/436 |
| 6,862,763 | B2 * | 3/2005 | Mossbeck et al. | 5/655.8 |
| 6,966,091 | B2 * | 11/2005 | Barber | 5/716 |
| 7,048,263 | B2 * | 5/2006 | Ahlqvist | 267/91 |

* cited by examiner

*Primary Examiner*—Michael Trettel
(74) *Attorney, Agent, or Firm*—Wood, Herron & Evans, LLP

(57) ABSTRACT

A mattress comprising coil springs arranged as spring units in covering pockets, a so-called pocket mattress, is provided. The spring units of the mattress are arranged in succession in elongate strings, the mattress comprising a plurality of such interconnected strings arranged side by side. A distinguishing feature of the mattress is that at least one spring unit within at least one string has a height that differs from the height of the other spring units within the same string. A method and a device for manufacturing such a mattress are also provided.

26 Claims, 8 Drawing Sheets

POCKET MATTRESS WITH VARYING HEIGHT

FIELD OF THE INVENTION

The present invention relates to a spring mattress comprising springs enclosed in coverings, a so-called pocket mattress, as well as a method and a device for manufacturing such a mattress.

BACKGROUND ART

A common technique for manufacturing spring mattresses is the "pocket technique". This means that the springs are enclosed in pockets, so-called covering pockets, i.e. they are individually enclosed by a covering material. In this way, the springs become relatively individually flexible, so that each spring may flex separately without affecting the neighbouring springs, thus increasing the user's comfort since his weight will be distributed more evenly over the surface receiving the load.

It also known from, inter alia, WO 00/00065, EP 1048248 and U.S. Pat. No. 5,222,264 to arrange alternately in a mattress spring units-with different properties by, for instance, arranging different units in different zones of the mattress which thus-will obtain, for instance, different degrees of hardness. A problem of these prior-art mattresses is, however, that the prior-art technique can only be used for variations of the properties of the mattress in local areas, not to affect the properties of the mattress in general. Furthermore, the known techniques for making such variations are expensive and complicated to use, which also makes the final products expensive and complicated.

A general problem of mattresses is also that different parts of the user's body press down the mattress to different degrees. This implies in the case of spring mattresses that the force exerted by the mattress springs on these certain parts of the user's body is significantly greater than the force acting on other parts of the body which depress the mattress to a smaller degree. This reduces the circulation of blood in these parts and is experienced as unpleasant and less comfortable.

To cope with this problem, it is known to arrange layers with different spring properties in the mattress. Such mattresses are disclosed, for instance, in WO 98/53724 and WO 99/35081 by the same applicant. A problem with this type of mattresses, however, is that they are relatively complicated and expensive to manufacture.

Therefore there is a need for a mattress which is easier and/or less expensive to manufacture but at the same time provides good comfort in relation to conventional mattresses.

OBJECT OF THE INVENTION

It is therefore an object of the present invention to provide a spring mattress of the type mentioned by way of introduction, as well as a method and a device for manufacturing the same, where the above drawbacks are wholly or at least partly eliminated.

This object is achieved by a spring mattress as well as a method for manufacturing the same according to the appended claims.

SUMMARY OF THE INVENTION

According to a first aspect of the invention, a mattress is provided, comprising coil springs arranged as spring units in covering pockets, said spring units being arranged in succession in elongate strings, the mattress comprising a plurality of such interconnected strings arranged side by side. At least one spring unit within at least one string has a height that differs from the height of the other spring units within the same string.

By means of the invention, there is provided a variation in height among the spring units within each string, in addition to a possible further variation between the strings. In this way, variations of the properties of the mattress across the mattress surface can be provided in a simple way. For example, it is possible to arrange lower and higher spring units in patterns, making the mattress obtain a softer surface layer and a more rigid lower layer. It is also possible to easily provide different zones of the mattress, such as zones with differently soft or differently thick surface layers, or zones with and without such surface layers.

The height of the spring can be varied between two positions, but it is also possible to use a plurality of different heights, in which case more than two layers of the mattress are obtained. For example, a three- or four-layer structure can easily be provided.

The mattress according to the invention is highly flexible and can be varied in a number of ways to achieve different types of mattress properties. As a result, mattresses with different properties can easily be manufactured in small series or the properties can even be specially adapted for each mattress. At the same time the mattress can be manufactured in a relatively uncomplicated and cost-effective manner.

Preferably, the mattress comprises a plurality of springs in a plurality of strings that have a height that differs from the height of the other spring units within each string. In this manner, a multilayer structure of the mattress can be obtained, for instance two-four layers with varying degrees of hardness arranged one above the other in the thickness direction of the mattress. Advantageously a large number of springs with varying height can be distributed over the mattress surface. Moreover, the number of units in each group of spring units with a different height can advantageously be the same, so that the ratio of the number of units in the group with the smallest number of units to the number of units in the group with the largest number of units exceeds e.g. 1/10, preferably 1/5 and most preferred 1/2.

It is further preferable for the spring units with a deviating height to be arranged in a regular, preferably repetitive pattern. For example, the spring units can form a check pattern, either in the longitudinal direction of, or diagonally over, the mattress. A pattern can also be provided by the strings which have spring units with a height differing from the height of the other spring units within each string being arranged so that these spring units are offset relative to each other in the longitudinal direction of the strings.

Moreover, the spring units with a deviating height are advantageously arranged in groups of at least two such spring units, which are arranged adjacent to one another. For example, the springs can be arranged in pairs or three by three.

The spring units with a height that differs from the height of the other spring units within each string can further be arranged so that different zones are formed in the mattress, which zones have different ratios of spring units with a varied height to the other spring units. In this way, the layers can, for instance, be adjusted to fit different parts of the user's body.

The strings of the mattress can be arranged so as to extend either in the longitudinal or in the transverse direction of the mattress. Since the position of the spring units with different heights can be controlled on the one hand by determining the relative positioning within each string and, on the other hand, by arranging the strings in differently offset or non-offset relations to each other, essentially any patterns for arranging the different spring units can be provided by means of the invention, whether the strings are arranged in the longitudinal or in the transverse direction.

With the mattress according to the invention, essentially all springs of the mattress can be essentially identical, the varying height of different spring units resulting in a varied bias of the springs. As a result, the manufacture will be simple and efficient since essentially the same components can be used for manufacturing a large number of different mattresses with different properties.

According to a second aspect of the invention, a corresponding method is provided for manufacturing a mattress as discussed above. The method comprises the steps of arranging coil springs as spring units in individual covering pockets in succession in elongate strings; interconnecting such strings side by side, and arranging at least one spring unit within at least one string with a height that differs from the height of the other spring units within the same string.

The above method presents advantages equivalent to those discussed above with regard to the mattress according to the invention and thus provides relatively uncomplicated and cost-effective manufacture of the type of mattresses as discussed by way of introduction.

According to this method, preferably a plurality of springs in a plurality of strings are arranged with a height that differs from the height of the other spring units within each string, and it is further preferred that the spring units with a deviating height be arranged in a regular, preferably repetitive pattern. This allows, inter alia, the multilayer structure of the mattress as discussed above. It is also preferable for the step of interconnecting the strings to be carried out so that strings with spring units with a height that differs from the height of the other spring units within each string are arranged so that these spring units are offset relative to each other in the longitudinal direction of the strings.

The step of arranging at least one spring unit within at least one string with a height that differs from the height of the other spring units within the same string further preferably comprises the step of limiting the volume of the covering pocket for said at least one spring unit. In this manner, the height can easily be adjusted and varied, and at the same time identical springs can be used in the entire mattress, which is advantageous in terms of production engineering. In addition to the primarily desired difference in height, this results in a difference in bias between the springs in the spring unit. This is advantageous since the springs have different properties in different states of bias, and this thus helps to provide a multilayer structure of the mattress. In case that the same degree of bias is desired in the entire mattress for some reason, this can be achieved by using springs with different heights, which are selected to be suitable.

The volume of the covering pocket can suitably be limited by introducing at least one surface interlocking for the casing, preferably by arranging a weld. In this way, essentially the same amount of material can be used for all spring units, but a weld is arranged in an appropriate place for provision of the varied height. This renders highly efficient and flexible production possible. It is particularly preferred that the step of arranging coil springs as spring units in individual covering pockets comprise the steps of folding a covering material in the longitudinal direction of the string; arranging welds in the transverse direction for partitioning off covering pockets; inserting springs into the covering pockets; and arranging a weld in the longitudinal direction of the string so as to seal the opening of the covering pockets. If this manufacturing method is used, the volume of the covering pockets can easily be limited by arranging at least one additional weld in the longitudinal direction in said covering pocket. This offers highly efficient and flexible manufacture. This additional weld can be arranged either in the vicinity of said weld in the longitudinal direction of the string to seal the opening of the covering pockets, or at a distance from said weld in the longitudinal direction of the string to seal the opening of the covering pockets, preferably in an opposite side of the covering pocket.

According to a third aspect of the invention, a corresponding device for manufacturing a mattress is provided. The device comprises means for arranging coil springs as spring units in individual covering pockets successively in elongate strings, and means for interconnecting such strings side by side. Moreover the device comprises means for varying the height of at least one spring unit within at least one string relative to the height of the other spring units within the same string. The means for varying the height of at least one spring unit within at least one string relative to the height of the other spring units within the same string preferably comprises means for limiting the volume of the covering pocket for said at least one spring unit.

The device above offers advantages equivalent to those discussed above with regard to the mattress and the method according to the invention, and thus provides relatively uncomplicated and cost-effective manufacturing equipment for manufacturing the type of mattresses discussed by way of introduction.

The means for arranging coil springs as spring units in individual covering pockets successively in elongate strings preferably comprises means for folding a covering material in the longitudinal direction of the string; first welding equipment for arranging welds in the transverse direction for partitioning off covering pockets; insertion means for inserting springs into the covering pockets; and second welding equipment for arranging a weld in the longitudinal direction of the string to seal the opening of the covering pockets. Moreover the means for varying the height of at least one spring unit within at least one string relative to the height of the other spring units within the same string preferably comprises means for arranging at least one additional weld in the longitudinal direction in said covering pocket. This offers relatively simple and cost-effective production equipment while at the same time flexible and efficient production can be obtained.

The means for arranging at least one additional weld in the longitudinal direction in said covering pocket comprises a means for making a relative motion in the transverse direction between the string that is to be welded and the welding equipment. The means for making a relative motion in the transverse direction between the string that is to be welded and the welding equipment comprises a movable supporting table for supporting the string during welding. Alternatively the means for making a relative motion in the transverse direction between the string that is to be welded and the welding equipment comprises displaceable welding equipment.

These and other aspects and features of the invention will be evident from the following description of specific embodiments of the invention, drawings and claims.

BRIEF DESCRIPTION OF THE DRAWINGS

The invention will now be described in more detail by way of embodiments and with reference to the accompanying drawings, in which.

DESCRIPTION OF PREFERRED EMBODIMENTS

Figure 1:
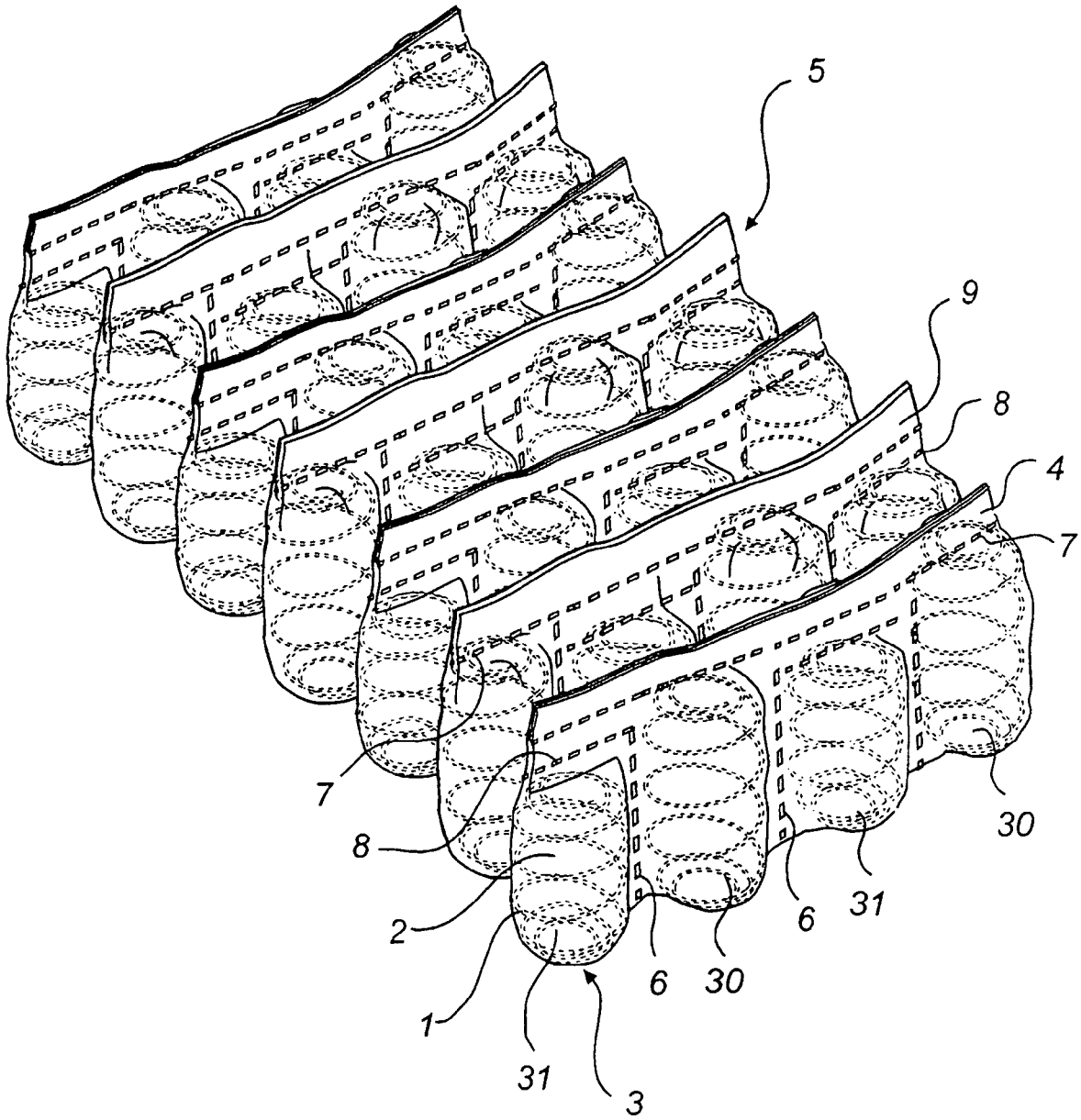
FIG. 1 is a perspective view of a portion of a mattress according to a first embodiment of the invention.
Figure 2:
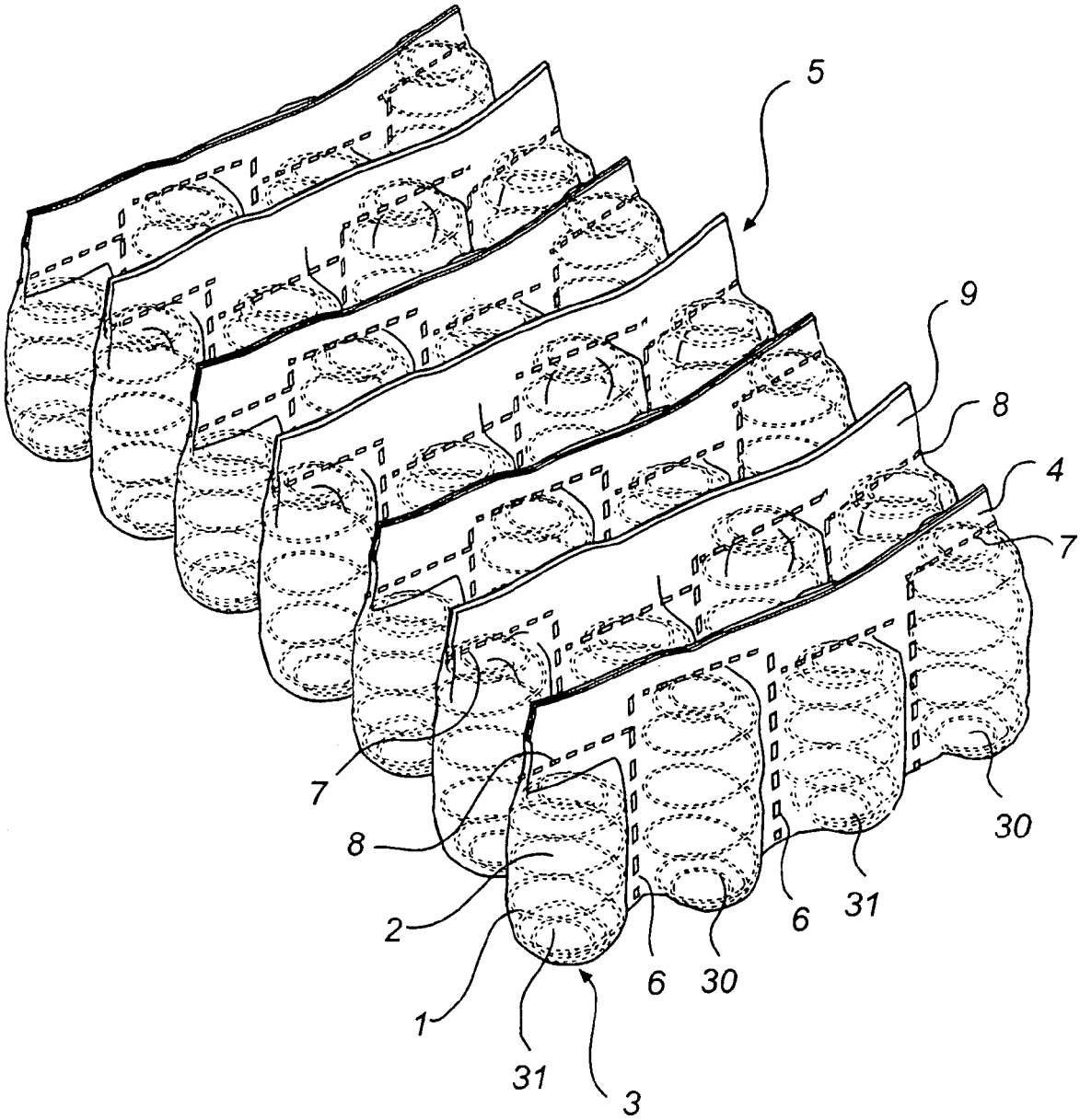
FIG. 2 is a perspective view of a portion of a mattress according to a second embodiment of the invention.

A spring mattress according to the invention comprises, as shown for instance in FIGS. 1–2, a plurality of interconnected coil springs 1 enclosed in covering pockets 2, thus forming spring units 3. The covering is suitably a, preferably weldable, textile material, but other materials, such as various types of plastic material, can also be used. It is also possible to use non-weldable textile materials, such as cotton cloth. Such mattresses, so-called pocket mattresses, are previously known. In manufacture, strings 4 of interconnected pocket springs in coverings are made automatically, whereupon these strings are cut into suitable lengths and joined side by side to form mattresses 5, which in itself is a previously known technique.

As mentioned above, the coverings with springs are preferably arranged in succession in strings, after which such strings are connected to each other side by side, as indicated in FIGS. 1–2. Preferably, the rows are fixed together at 2–3 vertically distributed fixing points exactly in front of each spring. It goes without saying that a greater or smaller number of fixing points is conceivable. It is also possible to arrange a longer fixing line essentially parallel to the longitudinal direction of the springs instead of a plurality of shorter fixing points. The interconnection of strings can take place by welding or gluing. Such interconnection, however, can alternatively be carried out by means of clamps or Velcro fasteners, or in some other convenient manner. It is also possible to interconnect strings by arranging additional cloth or the like over/under the strings.

Figure 3:
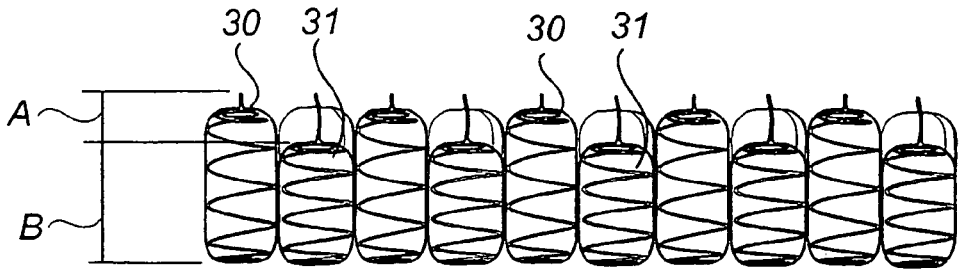
FIG. 3 is a side view in cross-section, transversely of the string direction of the mattress, of a portion of a mattress according to the first embodiment of the invention.

Within at least some strings, there are also arranged spring units 3 with a height that differs from the height of the other spring units 30 within the same string. Preferably, the mattress comprises a plurality of springs in a plurality of strings that have a height differing from the height of the other spring units within each string. In this way, a multilayer structure of the mattress can be obtained, with e.g. two-four layers with varying degrees of hardness arranged one above the other in the thickness direction of the mattress. In the embodiment in FIG. 3, a soft upper layer A and a hard lower layer B are provided.

Figure 5:
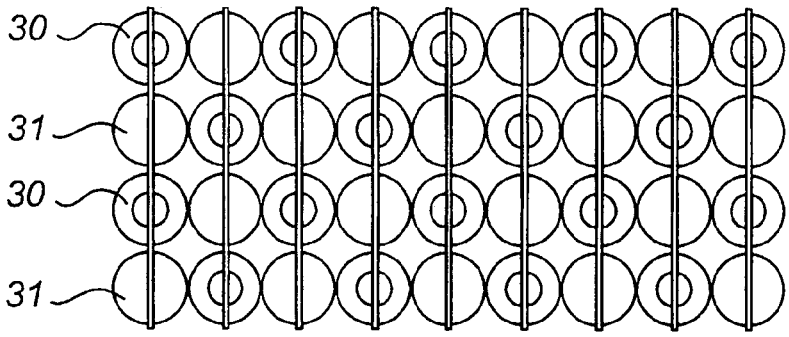
FIG. 5 is a schematic top plan view of a portion of a mattress according to the first embodiment of the invention;.

The spring units 30, 31 with different heights can advantageously be distributed over the surface of the mattress. In the first embodiment, shown in FIGS. 1, 3 and 5, the number of low spring units 31 is essentially the same as the number of high spring units 30, i.e. the ratio of the number of units in the group with the smallest number of units to the number of units in the group with the largest number of units is essentially 1. The spring units with a deviating height, i.e. the low spring units 31, are further arranged in a regular and repetitive pattern, where every second spring unit in the strings is high and every second is low. The strings are further offset relative to each other, so that also in a direction transversely of the longitudinal direction of the strings there are alternately high and low spring units. As a result, the spring units with the respective heights form diagonal lines across the surface of the mattress. This pattern is most clearly to be seen in, for instance, FIG. 5.

Figure 6:
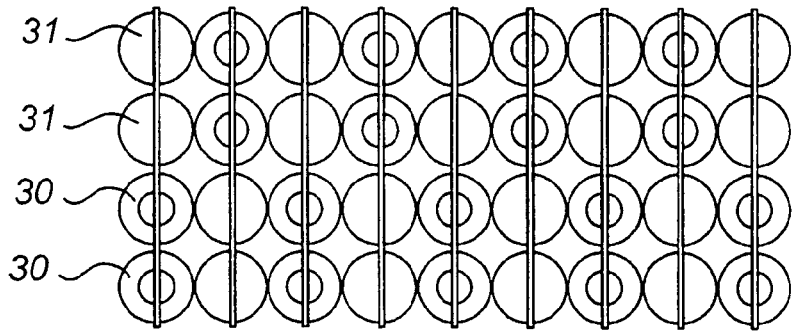
FIG. 6 is a schematic top plan view of a portion of a mattress according to a further embodiment of the invention.

In a second embodiment shown in FIG. 6, the number of low spring units 31 is essentially the same as the number of high spring units 30. The spring units are also in this case arranged in a regular and repetitive pattern, but here the spring units with the respective heights are arranged in pairs. Moreover the strings are offset relative to each other, but each string is offset by two spring positions.

Figure 7:
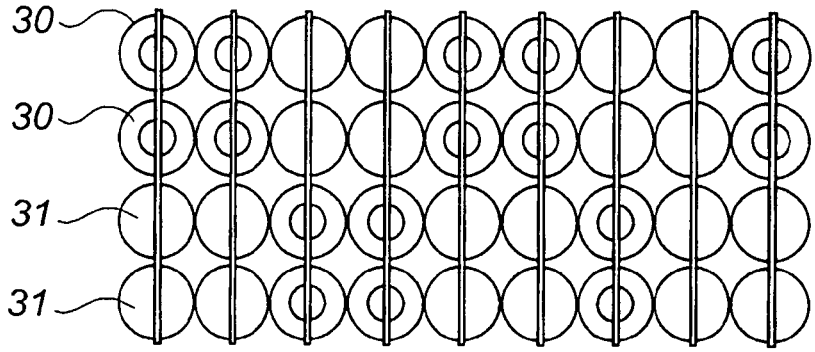
FIG. 7 is a schematic top plan view of a portion of a mattress according to another embodiment of the invention.

Also in a second embodiment, shown in FIG. 7, the number of low spring units 31 is essentially the same as the number of high spring units 30. Also in this case, the spring units are arranged in a regular and repetitive pattern, but here the spring units with the respective heights are arranged in pairs. The strings are offset relative to each other so that also in a direction transversely of the longitudinal direction of the strings alternately high and low spring units are arranged in pairs. The spring units form groups of spring units with different heights, which together form a check pattern.

Figure 8:
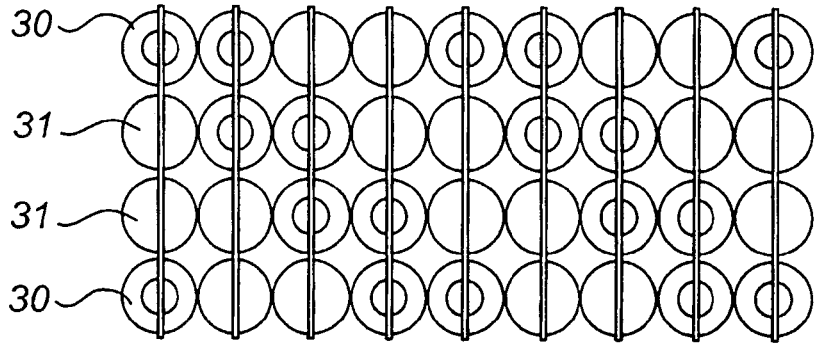
FIG. 8 is a schematic top plan view of a portion of a mattress according to another embodiment of the invention.

In a third embodiment, shown in FIG. 8, the number of low spring units 31 is essentially the same as the number of high spring units 30. The spring units are also in this case arranged in a regular and repetitive pattern, and the spring units with the respective heights are arranged in pairs within each string. The strings are further offset relative to each other so that also in a direction transversely of the longitudinal direction of the strings, alternately high and low spring units are arranged in pairs, but in contrast to the embodiment in FIG. 6, the displacement here corresponds to one spring unit only, not two. The spring units form diagonal zigzag lines across the surface of the mattress.

Figure 9:
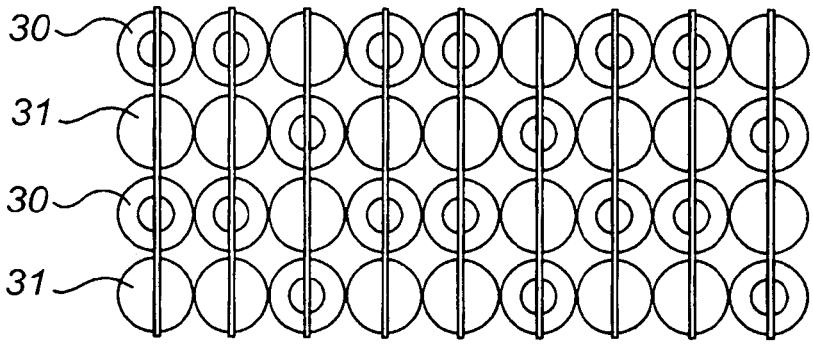
FIG. 9 is a schematic top plan view of a portion of a mattress according to another embodiment of the invention.
Figure 10A:
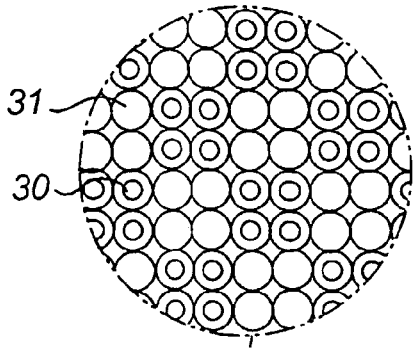
FIG. 10 is a top plan view of a mattress according to another embodiment of the invention, FIGS. 10*a*–10*c* illustrating schematic enlargements of marked areas.
Figure 10:
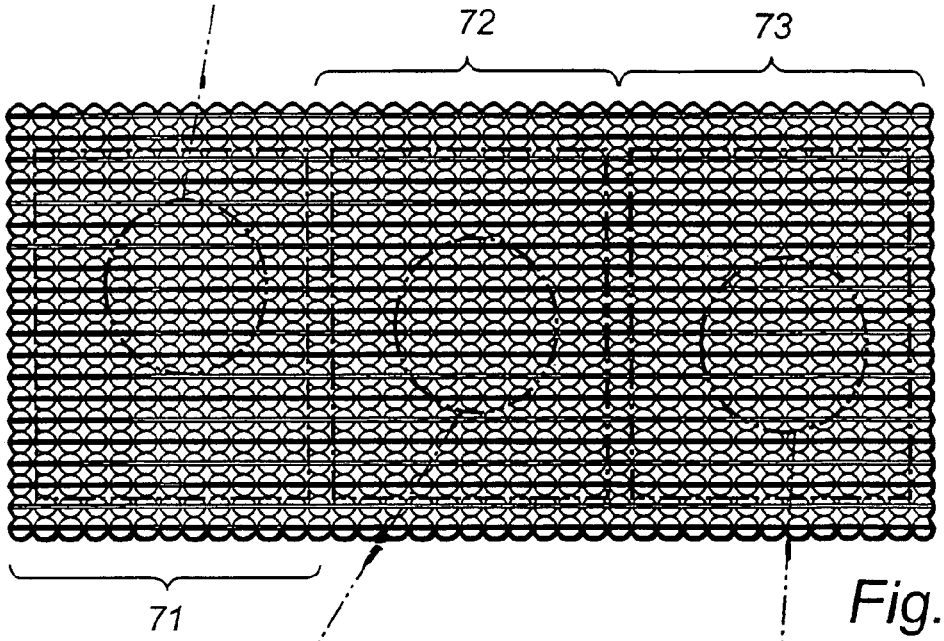
Figure 10B:
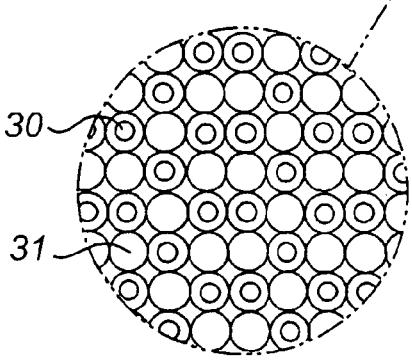
Figure 10C:
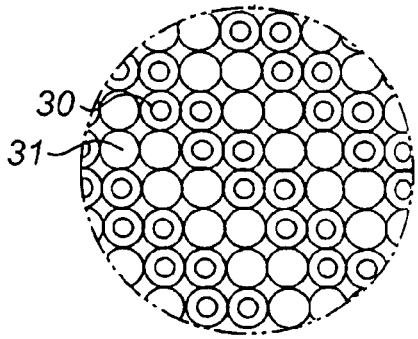

Also in a fourth embodiment, shown in FIG. 9, the number of low spring units 31 is essentially the same as the number of the spring units 30. The spring (units with a deviating height, i.e. the low-spring units 31, are arranged in a regular and repetitive pattern, where every second spring unit in the strings is high and every second is low. On the other hand, not all strings are offset relative to each other, but only every third string is offset. This pattern is clearly to be seen from e.g. FIG. 9.

Of course, many other types of pattern for arranging the different types of spring units are conceivable. Different patterns result in different mattress properties and may thus be selected to provide different types of mattresses.

Furthermore it is possible to use different patterns or different types of spring units in different zones of the mattress. In this way, for instance the layers can be adjusted to fit different parts of the user's body. In one Example, which is schematically shown in FIG. 10 and FIGS. 10*a–c*, three zones 71–73 are arranged in the mattress. In one of the end zones, 71, use is made of a pattern such as the one previously described with reference to FIG. 7, in the intermediate zone, 72, use is made of a pattern quite similar to the one previously described with reference to FIG. 9, and in the other end zone, 73, use is made of a pattern such as the one previously described with reference to FIG. 8.

However, it will be appreciated that many other options of arranging different zones in a mattress exist according to the invention. In the different zones, for instance one or more of the following parameters can be different:

The height of the spring units in-the different groups

The number of groups of spring units with different heights that are used (for instance one, two, three or more);

The ratio of the number of spring units of the respective groups that are used;

The pattern according to which the spring units are arranged; and

The springs that are used in the spring units in one or more of the groups.

It will also be appreciated that the zones do not have to be arranged as successive segments in the longitudinal direction of the mattress, but they may have any shape whatever across the surface of the mattress, such as inner zones that are completely enclosed by a surrounding outer zone.

Figure 11:
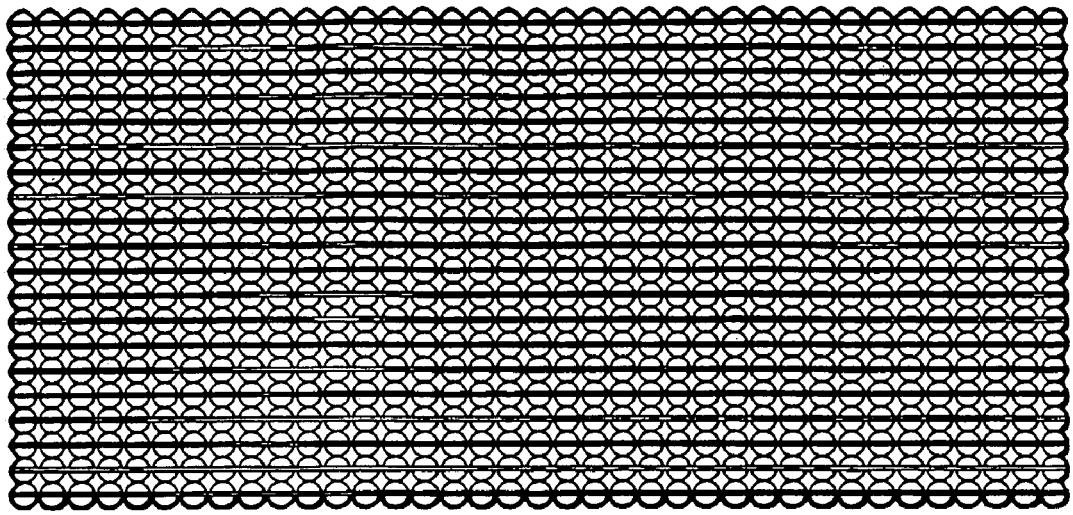
FIG. 11 is a top plan view of a mattress according to another embodiment of the invention.
Figure 12:
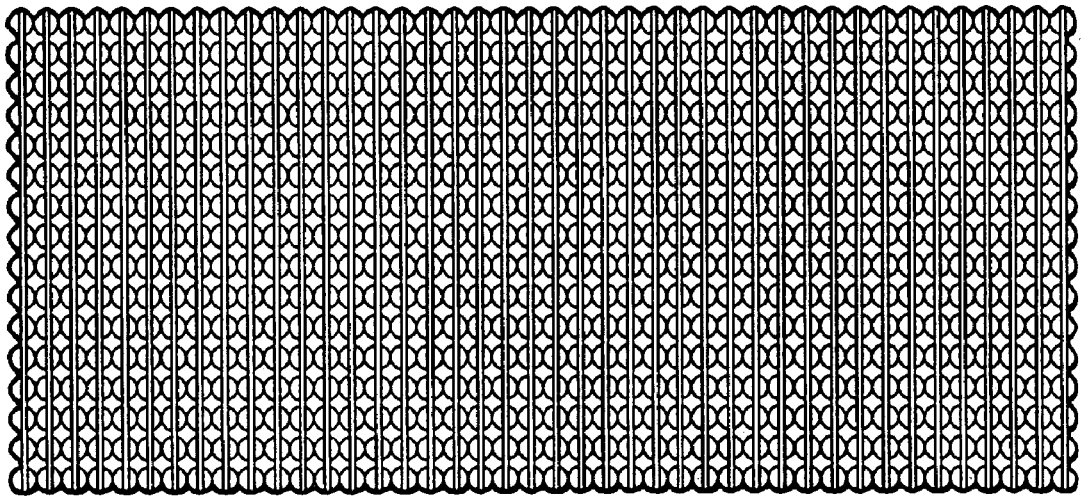
FIG. 12 is a top plan view of a mattress according to another embodiment of the invention.

The strings of the mattress, where at least one, and preferably essentially all strings have spring units with different heights, can be arranged so as to extend in the longitudinal direction of the mattress as shown in FIG. 11. This is advantageous since it means that longer strings can be manufactured and used, which is advantageous in terms of production. However, it is also possible to arrange the strings in the transverse direction of the mattress, as is evident from FIG. 12.

When manufacturing mattresses as described above, conventional and per se known methods and devices can to a large extent be used, for instance for inserting and enclosing springs in covering pockets, joining of strings to form mattresses and so on. Such methods and devices are previously known and will therefore not be described in detail in this text. For instance, such previously known, general equipment and methods for manufacturing pocket mattresses are disclosed in EP 0764608, EP 0781726, EP 0967031 and EP 0985369, which are herewith incorporated by reference.

Figure 15:
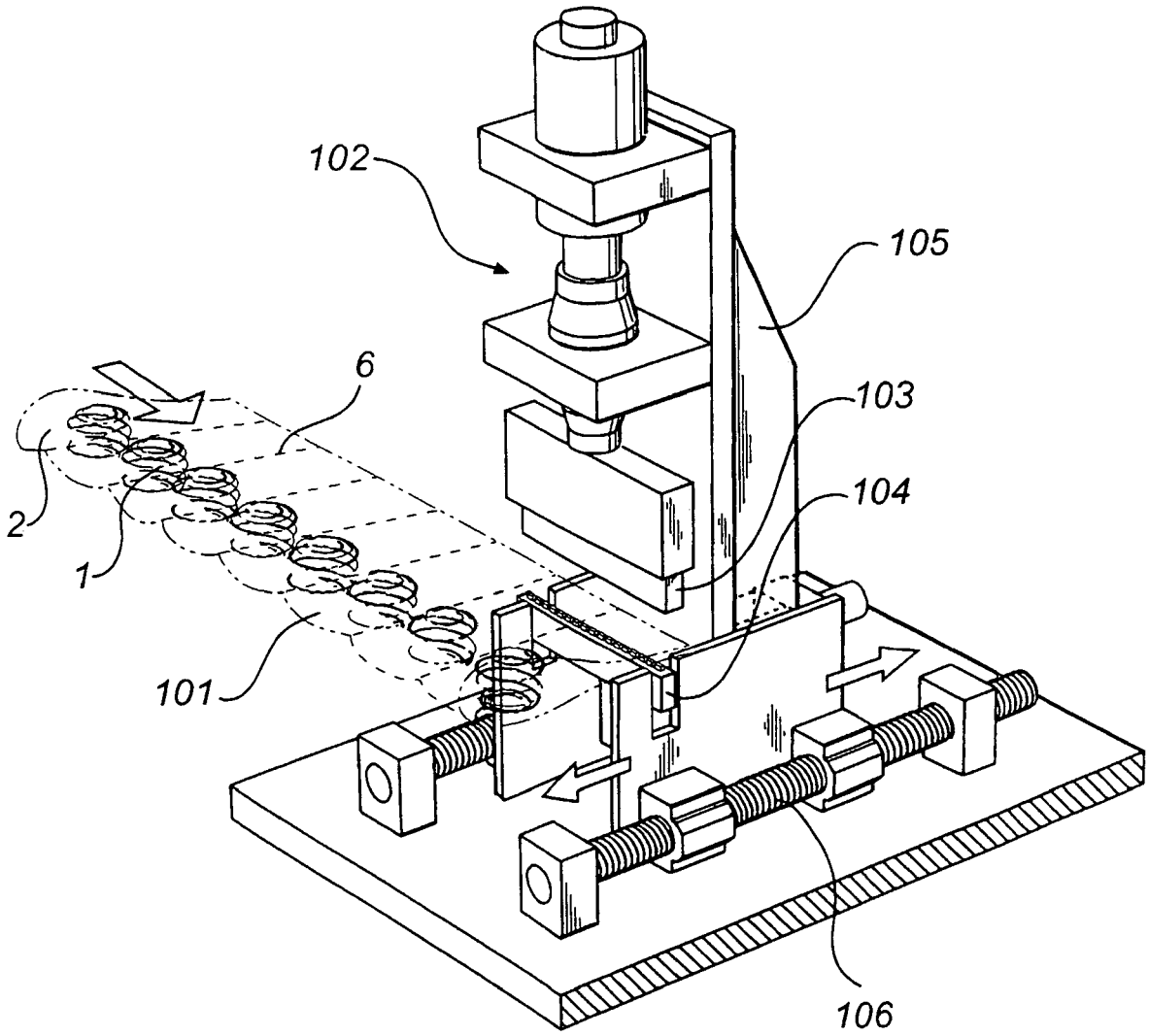
FIG. 15 is a perspective view of an embodiment of a device for manufacturing a mattress according to the invention.

With reference to FIG. 15 and FIG. 1, one embodiment for manufacturing a mattress as stated above will now be described. According to the embodiment, first a covering material 2 is folded in the longitudinal direction of the string that is to be manufactured. Subsequently welds 6 are arranged in the transverse direction for partitioning off covering pockets 3, which in this position have a bottom and sides which are formed by the folded covering material, and additional sides that are formed by the welds in the transverse direction. However, the pockets are still open towards one long side, at the end opposite to the bottom. In this state, compressed springs 1 can then be inserted into the covering pockets. Of course, it is also possible first to arrange the springs in the folded covering material and then arrange welds in the transverse direction between them. It is also possible first to compress springs and then fold the covering material over them.

After arranging the compressed springs in the covering pockets, the pockets are sealed also at the open end, for instance by arranging a weld 7 in the longitudinal direction of the string. Before or after sealing of the opening of the pockets, at least one additional weld 8 is arranged in the longitudinal direction in the covering pockets that are to form lower spring units, thus limiting the volume of these covering pockets and, thus, the height of the spring unit. Preferably, this additional weld 8 is arranged in the vicinity of the weld 8 in the longitudinal direction of the string. However, it is also possible to arrange the additional weld 8 at a distance from the sealing weld 7 instead, and then preferably at an opposite side of the covering pocket, i.e. in the bottom part of the covering.

Figure 4:
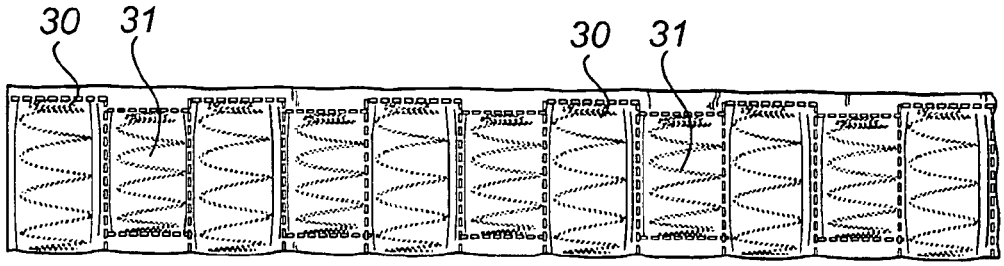
FIG. 4 is a side view, along the string direction of the mattress, of a portion of a mattress according to another embodiment of the invention.

As a further alternative, it is possible to arrange additional, limiting welds in both short sides of the spring units, as shown in FIG. 4. This makes it possible to provide a mattress with, for instance, multilayer properties on both sides of the mattress. In this way, the mattress will be reversible and usable on both sides. The properties of the mattress on the two sides can either be made identical, which results in the mattress being experienced to be identical independently which side is turned upwards, or different, which makes it possible to change the experience of the mattress by turning it around.

The limiting welds arranged on both sides of the mattress can be arranged immediately opposite each other, i.e. so that the same spring unit is limited on both sides, as shown in the Example in FIG. 4. Alternatively, they can be arranged offset relative to each other so that they limit different spring units. In this embodiment, the spring units still have different heights, seen from the respective surfaces of the mattress, but their absolute height, i.e. the factual extent perpendicular to the surfaces of the mattress, can in this embodiment be identical for all springs.

The means for arranging at least additional weld 8 in the longitudinal direction in said covering pocket comprises, as shown in FIG. 15, a means for making a relative motion in the transverse direction between the string that is to be welded and the welding equipment. The means for making a relative motion in the transverse direction between the string that is to be welded and the welding equipment may comprise a supporting table 101 for supporting the string during welding. Moreover welding equipment 102 is arranged for providing the weld. The welding equipment is in this case an ultrasonic welding unit with an ultrasonic horn 103, which in welding cooperates with a die 104 on the other side of the covering material that is to be welded. The welding equipment is arranged on a frame 105, which in turn is connected to displacement means 106 for displacing the welding equipment in a transverse direction relative to the supporting table 101 and the string that is to be welded. The displacement means comprise in this embodiment a linear motor, but other alternatives, such as pistons, chain mechanisms, are of course also conceivable.

Alternatively, it is also possible to let the displacement means 106 act against the supporting table, whereby the welding equipment can instead be fixed while the supporting table and the string are moved.

The displacement between supporting table/string and welding equipment can be arranged to take place between certain predetermined steps. However, it is preferable for this movement to take place gradually, which enables increased flexibility in the manufacturing process.

In the case where a relative motion between the string and the welding equipment is desired, the same welding equipment can advantageously be used to weld both the sealing weld 7 and the additional, volume-limiting weld 8. In this case, it is also possible only to arrange the sealing weld 7 over pockets where an additional, volume-limiting weld is not to be arranged. This results in essentially only one longitudinal weld, which does not run along a straight line, but has stepwise or gradual indentations.

In the Example in FIG. 1, an example of a mattress is shown where a sealing weld 7 is arranged along the entire string, and additional, volume-limiting welds 8 are arranged between the sealing weld 7 and the spring in the spring units that have a limited height.

In the Example in FIG. 2, an example of a mattress is shown, where the sealing weld 7 is only arranged over pockets where an additional, volume-limiting weld 8 is not to be arranged. As a result, essentially only one longitudinal weld is made, which does not run along a straight line, but has stepwise or gradual indentations.

In the case where different pieces of welding equipment are used, the welding equipment for providing the additional, volume-defining weld 8 can advantageously be arranged after the welding equipment for supplying the sealing weld 7, so that the weld 7 is arranged before the weld 8.

In the case where different pieces of welding equipment are used, it is also possible only to use two or more fixed pieces of welding equipment, i.e. pieces of equipment which are not displaceable relative to the supporting table and the string. Instead, in that case the pieces of welding equipment can be preinstalled at different levels in the transverse direction of the string.

After sealing of the covering pockets, the springs are then possibly turned, since it is normally preferred for the weld side to be positioned at a short side of the spring units, and the compression of the springs is released so that they expand the closed inner space formed in the covering pockets.

Then a plurality of strings are joined side by side, as indicated in FIG. 1. This can take place by arranging 2–3 vertically distributed glue or weld points using corresponding gluing or welding equipment. It is also possible to arrange a longer fixing line essentially parallel to the longitudinal direction of the springs instead of a plurality of shorter fixing points. As discussed above, interconnection can be controlled so that a desired pattern is obtained.

Coil springs of many sizes can be used in connection with the present invention, and essentially any size of springs can be used. However, it is preferable to use springs with a diameter of 2–10 cm, most preferably about 6 cm. The springs preferably comprise at least four coil turns, preferably fewer than 10 coil turns. Moreover they are advantageously made of spiral wire with a thickness in the range 0.5–3.0 mm, preferably a wire thickness in the range 1.5–2.2 mm. It is also possible to use coil springs of several different dimensions in the same mattress.

As discussed above, by using the invention it is possible to provide a large number of different properties of the mattress for different zones or for the entire surface of the mattress. However, it is also possible to use the inventive technique for other purposes.

Figure 13A:
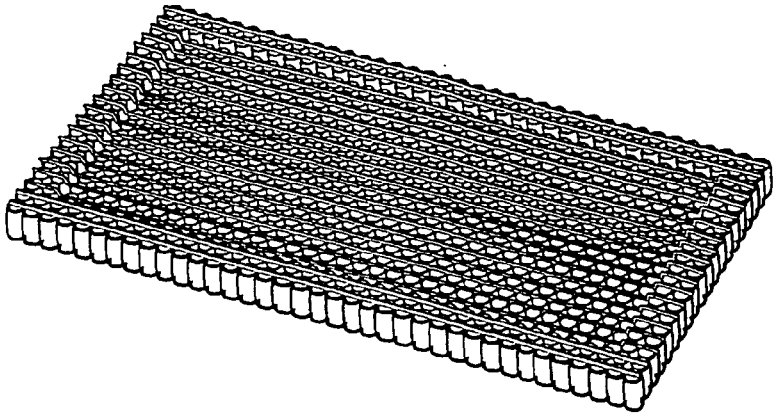
FIG. 13*a* being a perspective view of the mattress, and FIG. 13*b* being a cross-sectional view of part of the mattress in FIG. 13*a;*
Figure 13B:
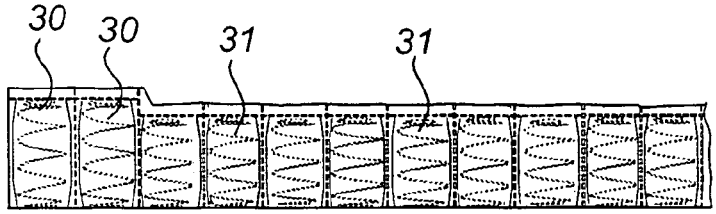
FIG. 13 illustrates a mattress according to another embodiment of the invention.

For example, it is possible to arrange lower spring units in the centre of the mattress and higher spring units as a frame round the mattress, or at least along one or some of the sides. An example of such an embodiment is shown in FIG. 13*a*, where a frame with a width of two spring units of higher spring units is arranged round the mattress. FIG. 13*b* is a cross-sectional view of part of the mattress, where the higher frame spring units are positioned to the left. With this mattress, an elevation is provided at the outer edge of the mattress, which prevents, for instance, a lying person from rolling off the bed. A similar effect can, however, be achieved, for instance, merely by arranging an elevated edge at one or both long sides.

The use of an elevated frame can, of course, be combined with, for instance, a pattern that results in a multilayer structure of the inner surface of the mattress, and it goes without saying that other combinations are also feasible.

Figure 14A:
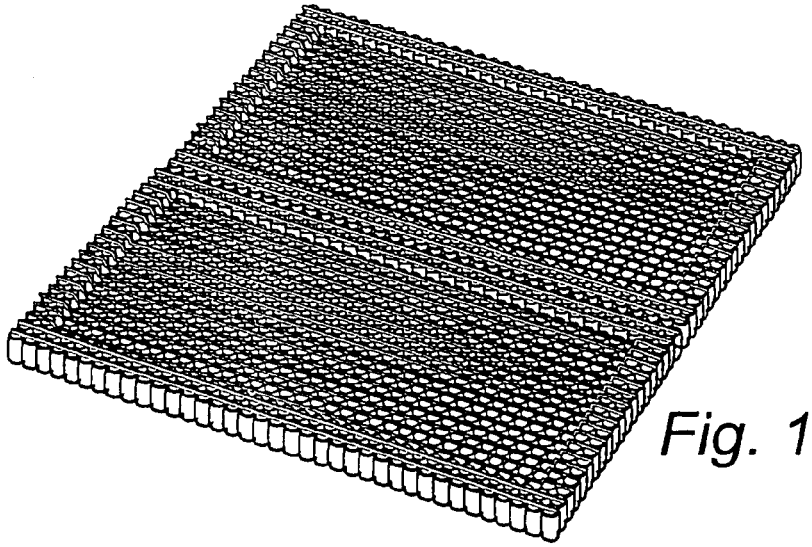
FIG. 14 illustrates a mattress according to another embodiment of the invention, FIG. 14*a* being a perspective view of the mattress, and FIG. 14*b* being a cross-sectional view of part of the mattress in FIG. 14*a*.
Figure 14B:
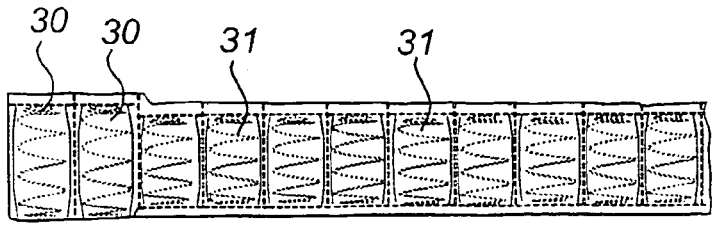

For double beds, it is also possible to arrange an elevation in the centre of the mattress so as to better partition off the different halves of the mattress, and prevent the mattress from sinking in the centre, which creates a "pit" in the mattress which by many people is experienced as uncomfortable. An example of such a mattress is shown in FIGS. 14*a* and 14*b*. The partition in the centre of the mattress can, of course, be combined with an outer frame or the like, as discussed above.

The invention has been described above by way of embodiments. However, several variants of the invention are feasible. For instance, other covering materials, spring sizes etc. can be used. Moreover the device and the method can be designed in other ways. The height of the springs can also be varied between several different heights, whereby more than two layers of the mattress are obtained. For instance, a three- or four-layer structure can in this way easily be provided. It is also possible to arrange the spring units with different heights in many other patterns than those discussed above. It is further possible to have the same number, or different numbers, of spring units with the respective heights. For partitioning off and sealing the covering pockets as well as for the interconnection of strings, several connecting means other than welding can be used. For instance, it would be possible to use glue, clamps, seams and rivets. All such obvious variants must be considered to be included in the invention as defined by the appended claims.

The invention claimed is:

1. A mattress comprising coil springs arranged as spring units in covering pockets, said spring units being arranged successively in elongate strings, the mattress comprising a plurality of such interconnected strings arranged side by side, characterised in that at least one spring unit within at least one string has a height that differs from the height of the other spring units within the same string.

2. A mattress as claimed in claim 1, wherein a plurality of springs in a plurality of strings have a height that differs from the height of the other spring units within each string.

3. A mattress as claimed in claim 2, wherein the spring units with a deviating height are arranged in a regular, preferably repetitive pattern.

4. A mattress as claimed in claim 2, wherein the spring units with a deviating height are arranged in groups of at least two such spring units, which are arranged adjacent to one another.

5. A mattress as claimed in any one of claim 2, wherein the strings having spring units with a height that differs from the height of the other spring units in each string are arranged so that these spring units are offset relative to each other in the longitudinal direction of the strings.

6. A mattress as claimed in any one of claim 2, wherein the spring units with a height that differs from the height of the other spring units within each string are arranged so that different zones are formed in the mattress.

7. A mattress as claimed in claim 1, wherein the strings are arranged so as to extend in the longitudinal direction of the mattress.

8. A mattress as claimed in claim 1, wherein the strings are arranged so as to extend in the transverse direction of the mattress.

9. A mattress as claimed in claim 1, wherein essentially all springs of the mattress are essentially identical, the varying height of different spring units resulting in a varied bias of the springs.

10. A method for manufacturing a mattress, comprising the steps of arranging coil springs as spring units in individual covering pockets in succession in elongate strings;

interconnecting such strings side by side, characterised by the further step of arranging at least one spring unit within at least one string with a height that differs from the height of the other spring units within the same string.

11. A method as claimed in claim 10, wherein a plurality of springs in a plurality of strings are arranged with a height that differs from the height of the other spring units within each string.

12. A method as claimed in claim 11, wherein the spring units with a deviating height are arranged in a regular, preferably repetitive pattern.

13. A method as claimed in claim 11, wherein the step of interconnecting the strings is carried out so that strings with spring units with a height that differs from the height of the other spring units within each string are arranged so that these spring units are offset relative to each other in the longitudinal direction of the strings.

14. A method as claimed in claim 10, wherein the step of arranging at least one spring unit within at least one string with a height that differs from the height of the other spring units within the same string comprises the step of limiting the volume of the covering pocket for said at least one spring unit.

15. A method as claimed in claim 14, wherein the volume of the covering pocket is limited by providing at least one surface interlocking for the covering, preferably by arranging a weld.

16. A method as claimed in claim 10, wherein the step of arranging coil springs as spring units in individual covering pockets comprises the steps of folding a covering material in the longitudinal direction of the string;

arranging welds in the transverse direction for partitioning off covering pockets;

inserting springs into the covering pockets; and arranging a weld in the longitudinal direction of the string so as to seal the opening of the covering pockets.

17. A method as claimed in claim 16, wherein the volume of at least one covering pocket is limited by arranging at least one additional weld in the longitudinal direction in said covering pocket.

18. A method as claimed in claim 17, wherein said additional weld is arranged in the vicinity of said weld in the longitudinal direction of the string so as to seal the opening of the covering pockets.

19. A method as claimed in claim 17, wherein said additional weld is arranged at a distance from said weld in the longitudinal direction of the string so as to seal the opening of the covering pockets, preferably in an opposite side of the covering pocket.

20. A device for manufacturing a mattress, comprising means for arranging coil springs as spring units in individual covering pockets in succession in elongate strings, and means for interconnecting such strings side by side, characterised in that it further comprises means for varying the height of at least one spring unit within at least one string relative to the height of the other spring units within the same string.

21. A device as claimed in claim 20, wherein the means for varying the height of at least one spring unit within at least one string relative to the height of the other spring units within the same string comprises means for limiting the volume of the covering pocket for said at least one spring unit.

22. A device as claimed in claim 20, wherein the means for arranging coil springs as spring units in individual covering pockets in succession in elongate strings comprises means for folding a covering material in the longitudinal direction of the string;

first welding equipment for arranging welds in the transverse direction for partitioning off covering pockets;

insertion means for inserting springs into the covering pockets; and second welding equipment for arranging a weld in the longitudinal direction of the string so as to seal the opening of the covering pockets.

23. A device as claimed in claim 22, wherein the means for varying the height of at least one spring unit within at least one string relative to the height of the other spring units within the same string comprises means for arranging at least one additional weld in the longitudinal direction in said covering pocket.

24. A device as claimed in claim 23, wherein means for arranging at least one additional weld in the longitudinal direction in said covering pocket comprises a means for making a relative motion in the transverse direction between the string that is to be welded and the welding equipment.

25. A device as claimed in claim 24, wherein the means for making a relative motion in the transverse direction between the string that is to be welded and the welding equipment comprises a movable supporting table for supporting the string during welding.

26. A device as claimed in claim 24, wherein the means for making a relative motion in the transverse direction between the string that is to be welded and the welding equipment comprises displaceable welding equipment.

* * * * *